US007530339B2

(12) United States Patent
Ritter

(10) Patent No.: US 7,530,339 B2
(45) **Date of Patent: *May 12, 2009**

(54) DURABLE VALVE LIFTER FOR COMBUSTION ENGINES AND METHODS OF MAKING SAME

(75) Inventor: Clyde G. Ritter, Bozeman, MT (US)

(73) Assignee: Jerry Burnham of C & B Aviation, Sturgis, SD (US)

( * ) Notice: Subject to any disclaimer, the term of this patent is extended or adjusted under 35 U.S.C. 154(b) by 190 days.

This patent is subject to a terminal disclaimer.

(21) Appl. No.: 11/501,666

(22) Filed: Aug. 8, 2006

(65) Prior Publication Data

US 2007/0034185 A1 Feb. 15, 2007

Related U.S. Application Data

(63) Continuation-in-part of application No. 10/697,836, filed on Oct. 29, 2003, now Pat. No. 7,086,361.

(51) Int. Cl.
*F01L 1/14* (2006.01)

(52) U.S. Cl. ..... 123/90.48; 123/90.44; 123/90.51; 123/90.61; 74/569

(58) Field of Classification Search ..... 123/90.39, 123/90.44, 90.48, 90.5, 90.52, 90.6, 90.51, 123/90.55, 90.61, 90.62, 90.63; 74/559, 74/567, 569

See application file for complete search history.

(56) References Cited

U.S. PATENT DOCUMENTS

| | | | | |
|---|---|---|---|---|
| 3,683,876 A | | 8/1972 | Lesher | 123/90.51 |
| 4,251,273 A | | 2/1981 | Smith et al. | 75/200 |
| 4,366,785 A | | 1/1983 | Goloff et al. | 123/90.51 |
| 4,667,627 A | | 5/1987 | Matsui et al. | 123/193.6 |
| 4,740,429 A | | 4/1988 | Tsuno | 428/627 |
| 4,768,476 A | | 9/1988 | Behnke et al. | 123/90.51 |
| 5,060,607 A | * | 10/1991 | Taniguchi | 123/90.51 |
| 5,168,841 A | | 12/1992 | Suzuki et al. | 123/90.48 |
| 5,253,418 A | | 10/1993 | Taniguchi et al. | 29/888.43 |
| 5,471,092 A | | 11/1995 | Chan et al. | 257/753 |
| 5,500,499 A | | 3/1996 | Seki et al. | 218/130 |
| 6,073,345 A | | 6/2000 | Mori et al. | 29/888.43 |
| 7,086,361 B2 | * | 8/2006 | Ritter | 123/90.51 |

* cited by examiner

*Primary Examiner*—Ching Chang
(74) *Attorney, Agent, or Firm*—Pedersen & Co., PLLC; Ken J. Pedersen; Barbara S. Pedersen

(57) ABSTRACT

A valve system lifter for combustion engines includes a hard metal face pad connected to a lower-grade metal lifter body. The connecting material is one or more materials that are different from both the lifter body and the face pad. Preferably, the connecting material is a silver-and copper-containing material, that may take the form of a wafer with silver or silver alloy layered over a copper alloy core. The preferred body includes one or more ferrous compounds, and the preferred face includes tungsten carbide. The resulting lifter is resistant to the cracking, breakage, and wear that plague conventional lifters, due to the harsh temperature and impact environment of the lifter. The resulting lifter may be used to reduce the need for change-out and down-time in many engines.

20 Claims, 4 Drawing Sheets

DURABLE VALVE LIFTER FOR COMBUSTION ENGINES AND METHODS OF MAKING SAME

This application is a continuation-in-part, and claims priority from U.S. patent application Ser. No. 10/697,836, filed Oct. 29, 2003, entitled Durable Valve Lifter for Combustion Engines and Methods of Making Same, issuing on Aug. 8, 2006 as U.S. Pat. No. 7,086,361, which is incorporated herein by this reference.

BACKGROUND OF THE INVENTION

1. Field of the Invention

This invention relates generally to valve lifters for combustion engines. More specifically, this invention relates to an improved lifter composition and method of fabricating a lifter for aircraft and other combustion engines, for reducing lifter damage or failure due to thermal fatigue and/or wear.

2. Related Art

Lifters 10 for combustion engine valve systems 12 serve as the contact members for the rotating cams 14. During each rotation of the cam 14, the cam surface 16 rotates into contact with the lifter 10 and slides along the lifter's face surface, thus pushing the lifter 10 with a force having a component parallel to the longitudinal axis of the lifter. The cam's rotating motion is therefore translated to linear motion of the lifter and the connected push rod 18 and, hence, to a pivoting motion of the rocker arm 20, in order to control the valve position 21.

The repeated, rapid engagement and disengagement of the cam surface 16 with the lifter face surface 22 presents a great potential for wear and/or damage to the lifter. Typically, there is a small clearance of several thousandths of an inch between the cam 14 and the lifter 10 when the cam is rotated so that the small diameter surface 17 faces the lifter. This clearance is designed to allow for heat expansion. Therefore, when the large-diameter portion 24 of the cam rotates toward the lifter 10, portion 24 hits the lifter and the cam surface 16 slides along the lifter surface 22 to raise the lifter 10. Then, as the small-diameter portion 26 rotates toward the lifter, the cam lowers the lifter and disengages from the lifter 10 due to the clearance. Thus, in each full rotation, the lifter and cam surfaces leave contact with each other during part of the cam's rotation, and then hit each other again for the remainder of the rotation.

Because of this demanding environment, the lifter has often been a point of wear and fatigue in the valve system 12, resulting in frequent change-outs of the lifters 12, or, worse, in engine damage. For many aviation engines, a major maintenance program is the replacement of lifters on a frequent and set schedule to prevent possible engine damage and/or failure.

Conventional valve lifters typically are generally cylindrical and solid, and are typically composed of cast iron, cast iron alloys, or other ferrous materials. Many of today's aircraft lifters are low grade steel that has been heat-treated to harden their face surfaces. The hardened, low grade steel surface tends to crack under the stresses of temperature changes and the repeated impact of the cam, and the cracked lifter then grinds down the cam surface, resulting in cam/lifter failure or engine failure.

Two-piece lifter bodies have been made, for example, as in U.S. Pat. No. 3,200,801, wherein a portion of low alloy steel is interposed between a stainless steel portion and an alloy cast iron foot piece. U.S. Pat. No. 3,657,800 discloses a lifter wear plate of graphitic alloy steel friction welded to a steel tube. U.S. Pat. No. 4,251,273 discloses various methods of manufacturing lifters.

What is still needed is a strong and durable valve lifter that may be made of economical materials. What is needed is a valve lifter that requires less frequent replacement and causes less frequent failure.

SUMMARY OF THE INVENTION

The present invention comprises a combustion engine valve lifter that is less prone to wear and fatigue than conventional lifters. An object of the present invention is to lessen the effects of stress on the lifter normally caused by the combination of thermal effects in the engine and repeated impact of the lifter by the cam. The invented lifter may be used in many combustion engines, such as Teledyne Continental, Avco Lycoming, or other aircraft engines, or various truck and car engines.

The lifter comprises attaching a hard face pad on a lifter, the hard face pad being of a different material than the body of the lift, preferably wherein the face pad is hard, durable and non-brittle relative to the lift body. The face pad may comprise one or more metal carbides, and the body may comprise a dissimilar metal such as iron, steel or another ferrous alloy. The face pad is connected to a lifter body by connecting material, which preferably comprises at least one layer of metal or other material that is different from both the lifter body and the lifter face pad. Preferably, the connecting material may comprise a silver solder or brazing material. The connecting material may comprise a plurality of metals, for example, that is, mixtures of metals, and/or layers of metals or metal mixtures. An especially preferred connecting material comprises a layer of copper or copper alloy sandwiched between two layers of silver or silver alloy.

The layered arrangement of materials in the invented lifter may be secured by induction welding or other methods that firmly anchor the various layers together. The connecting materials may be provided in the form of a pre-fabricated wafer that is inserted between the lifter face and the lifter body in the induction welding apparatus. In the embodiment including a three-layer silver-copper-silver wafer as the connecting materials, the silver layers liquefy during induction welding, and bond to the body and face pad, resulting in a lifter substantially made of a ferrous alloy body, a metal carbide face, and a copper alloy interlayer attached by silver welds to the body and face.

DESCRIPTION OF THE PREFERRED EMBODIMENT

Figure 1:
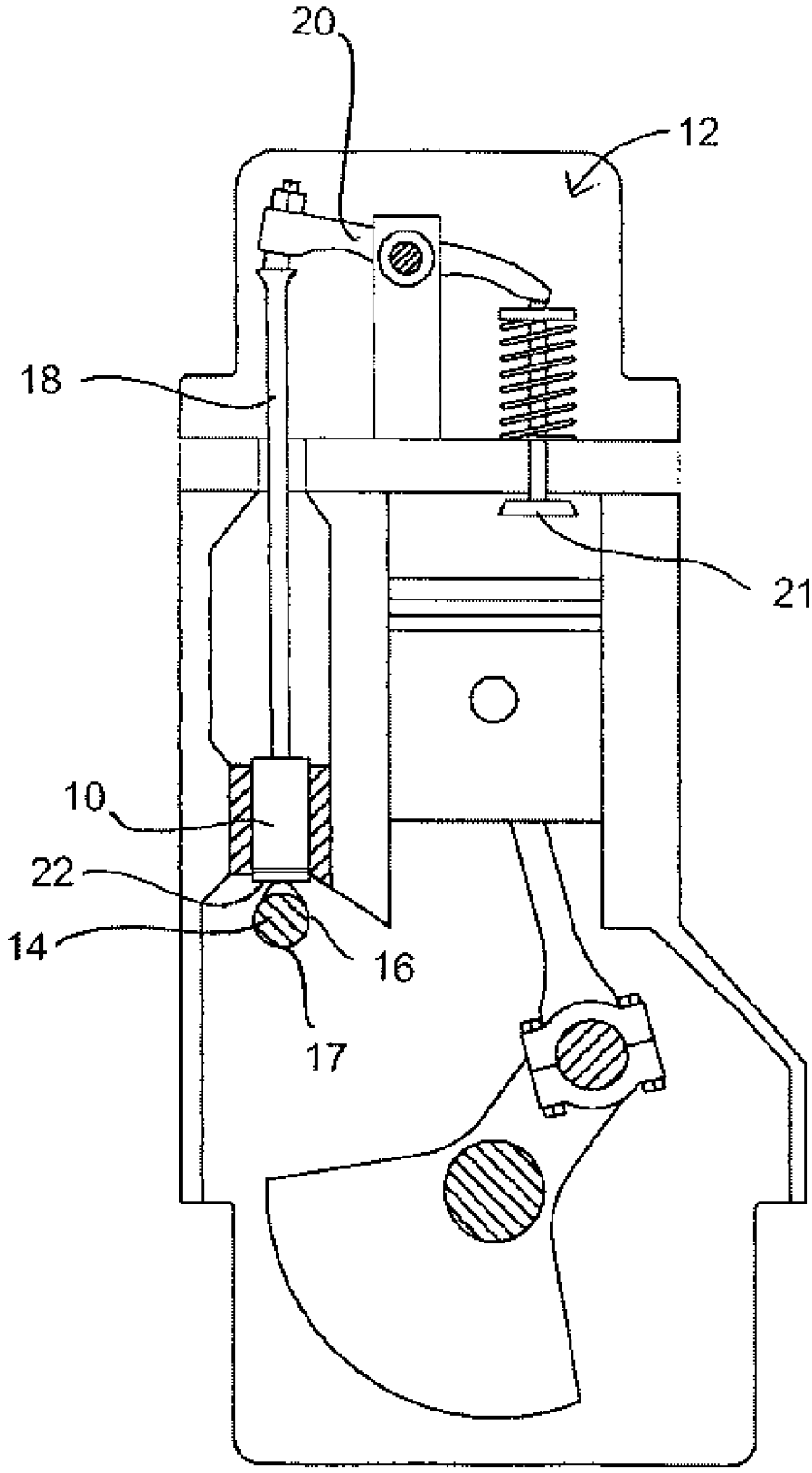
FIG. 1 shows a schematic, cross-sectional side view of a portion of a combustion engine, featuring a valve system with a lifter, push-bar, and rocker arm.

Referring to the Figures, there is shown one, but not the only, embodiment of the invented lifter 40. The lifter 40 may be used in various piston-powered/combustion engines, and is expected to work well in many aircraft engines, automobile engines, truck engines, etc. The lifter 40 may replace many conventional lifters in environments illustrated by, but not limited to, the engine design suggested by FIG. 1.

The lifter 40 comprises an elongated body 42, which may be made of a ferrous material, such as cast iron, steel, stainless steel, or another ferrous alloy, or a non-ferrous material, such as bronze or copper-based non-ferrous materials. A preferred body is made from any of the "40 series" steels, such as "4142" steel or "4140" steel. The body is typically cylindrical, about 1-1½ inch in diameter and about 2¼-2½ inches long, but other sizes and shapes may be used for various engines.

The face pad 44 is generally the same diameter as the body 42, and has a thickness (length) of about 100-125 thousandths of an inch, but may be other shapes and thicknesses as needed for various engines. The inventor expects that a face pad in the range of 75-200 thousandths of an inch will work well in most lifters. The preferred lifter pad is a 1.25 inch diameter disc containing metal carbide or a plurality of metal carbides. Especially preferred metal carbide wafers are of the general description of "Refractory Metal Carbide" (also called "hard metal, cemented WC, or simply tungsten carbide). Especially-preferred metal carbides are of the type called "tungsten carbide with cobalt binder," which include tungsten carbide, cobalt, tantalum carbide, titanium carbide, and niobium carbide. Various compositions may range, for example, from 30-97.7 wt-% tungsten carbide, 2-25 wt-% cobalt, 0.1-15 wt-% tantalum carbide, 0.1-15wt-% titanium carbide, and 0.1-5 wt-% niobium carbide. One such preferred tungsten carbide wafer is available from Kennametal, of 18105 Cleveland Parkway, Cleveland, Ohio 44135, under the name "K-94," North American Industry Classification System (NAICS) metal number 1955480, while other variations are available from the same source under names such as K-90, K-91, K-96, K 40, etc. Thus, while 30-97.7 wt-% tungsten carbide material is preferred, other carbide alloys may be used, such as those with more titanium carbide, tantalum carbide, or niobium carbide, for example.

A silver-containing connecting material is preferably used to attach the face pad 44 to the body 42. The connector may be a layered connector 41 secured between the body 42 and the face 44. The especially-preferred connector 41 comprises a three-layer wafer, including top and bottom layers 48, 50 on either side of a middle layer 46. The three layers of the connector 41 may comprises a copper or copper alloy sheet as the central (middle) layer 46 sandwiched between silver or silver alloy sheets as the top and bottom layers 48, 50. The three layers are preferably bonded together, prior to insertion between the body 42 and the face 44, using conventional metallurgy methods, such as compression, stamping, heating, or other methods of affixing the various layers into a single wafer.

Connecting materials in the range of 40-60 wt-% silver are preferred, with copper, zinc, and/or cadmium in the range of 10 wt-% -20 wt-%, plus small amounts (less than 10 wt-%) of other metals and trace components. A connecting material of substantially silver and copper is available as a prefabricated wafer from Prince & Izant Company, of P.O. Box 931247, Cleveland, Ohio, 44193, under the alloy name of "TRI50Ni3" and under American Metallurgical Society Number (AMSN) #4771. This layered wafer comprises approximately 50 wt-% silver (+/−1wt-%), 15.5 wt-% copper (+/−1 wt-%), 15.5 wt-% zinc ( +/−2 wt-%), 16 wt-% cadmium (+/−1 wt-%),3 wt-% nickel (+/−0.5 wt-%), plus 0.15 wt-% maximum trace materials. This preferred material has a melting point of 1170 degrees F, and a brazing temperature range of 1270-1500 degrees F. Alternatively, another wafer named "50Ni2" is available from the same source, and is approximately 50 wt-% silver, 20 wt-% copper, 28 wt-% zinc, and 2 wt-% nickel.

Preferably, the wafer connector 41 has a diameter equal to that of the face 44 and a total thickness between about 10-30 thousandths of an inch, and most preferably about 15 thousandths of an inch prior to welding to the body 42 and face 44. The copper layer comprising substantially copper, cadmium, and zinc, is greater than about 70% of the thickness of the wafer connection 41, and the silver layers 48, 50 each comprise less than about 15% of the thickness of the wafer. Thus, for a wafer connector 41 that is 15 thousandths of an inch, the copper layer is about 10-11 thousandths inch, and the two silver layers are each about 2 thousandths inch thick. Alternatively, one would expect other wafer connectors to have a copper/zinc and nickel up to about 14 thousandths, and each of two silver alloy layers to be up to about 8 thousandths of an inch thick.

Figure 2:
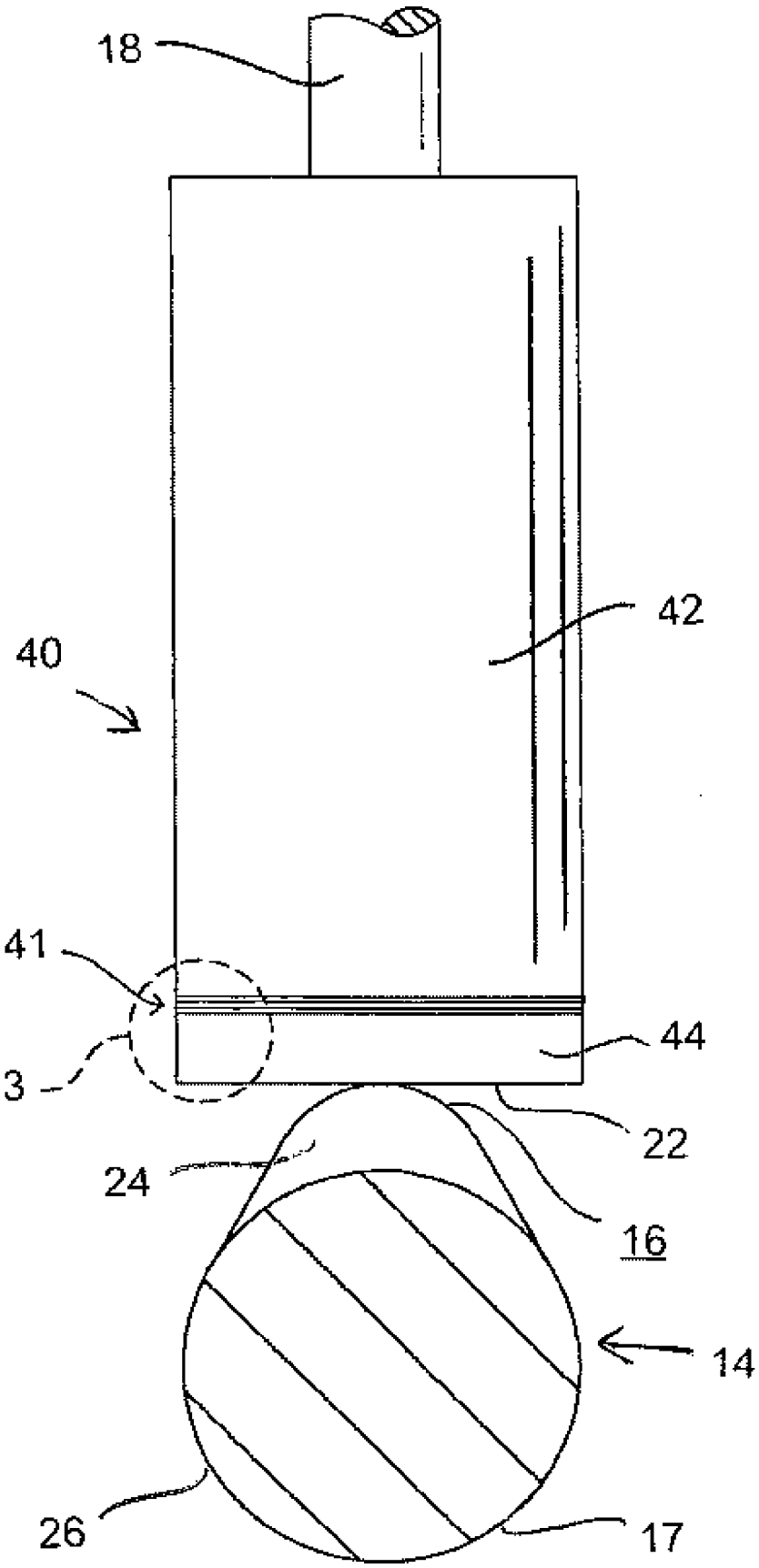
FIG. 2 shows a side view of one embodiment of the lifter according to the invention, shown in use with a cross-sectional view of a cam.
Figure 3:
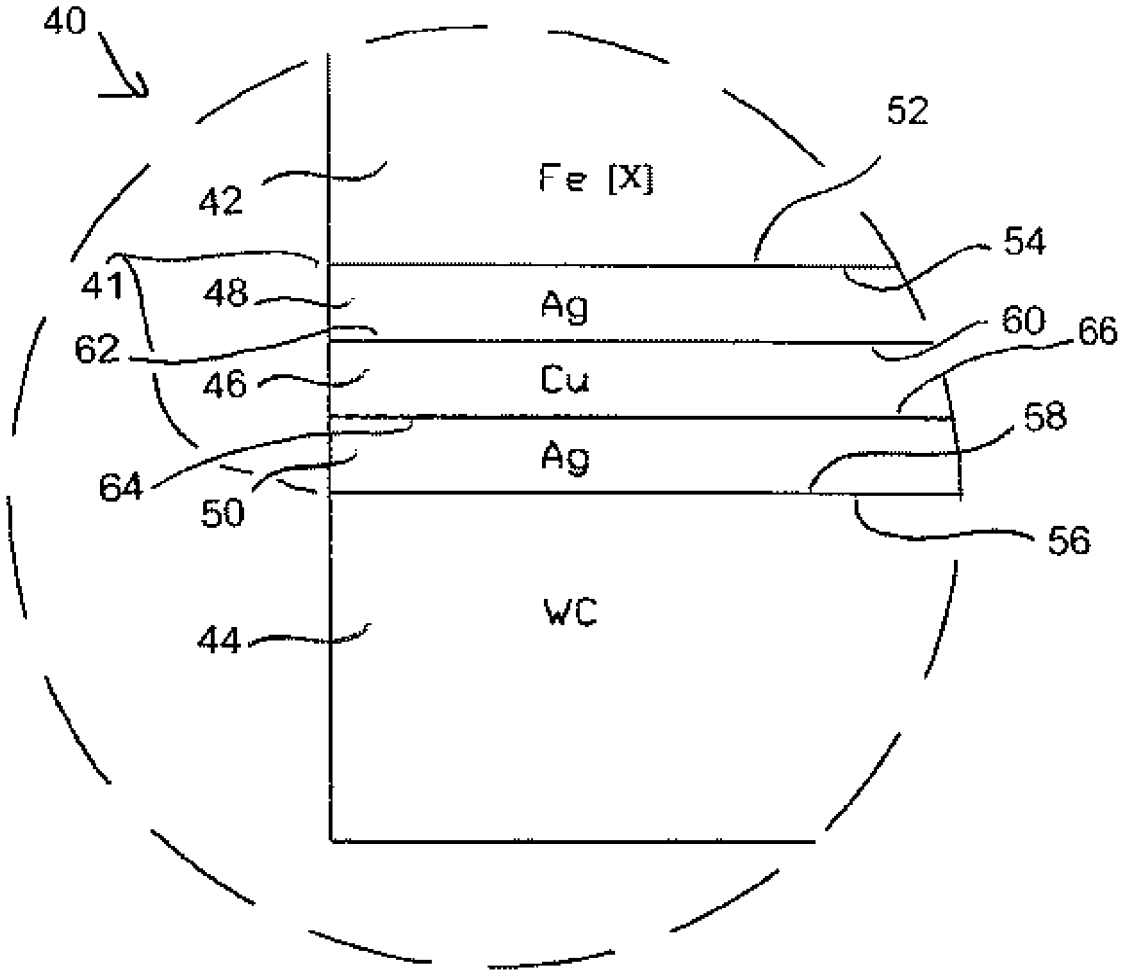
FIG. 3 is a detail view of a portion of the lifter of FIG. 2, indicated by dashed lines in FIG. 2 to be a lower portion of the lifter, with Fe[X] representing iron and iron alloys.
Figure 4:
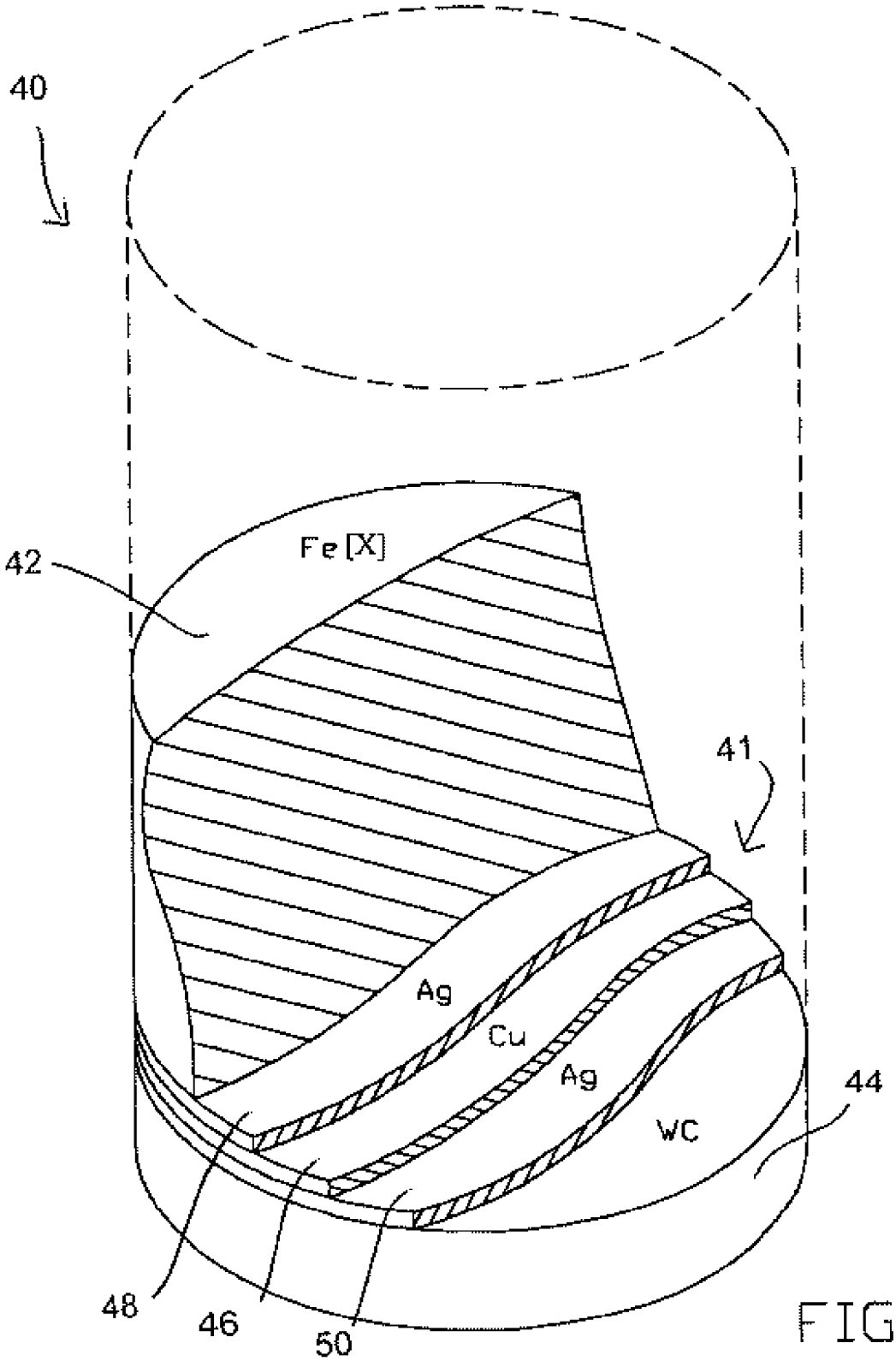
FIG. 4 is a cut-away view of the lifter of FIG. 2, illustrating the metal layer connection between the lifter body and the lifter face.

The layered connector 41 is bonded/attached to both the body 42 and face 44 by welding methods such as induction heating/welding in the range of about 1200-1400 degrees F., wherein the silver layers liquify and bind to the ferrous body 42 and to the metal carbide face 44. The top surface 52 of the top silver layer 48 (when viewed in the orientation of FIGS. 2 and 4) is securely bonded to the bottom surface 54 of the body 42, and the bottom surface 56 of the bottom silver layer 50 is securely bonded to the top surface 58 of the face 44. Likewise, the bottom surface 60 of the top silver layer 48 is bonded to the top surface 62 of the copper layer 46, and the bottom surface 64 of the copper layer 46 is bonded to the top surface 66 of the bottom silver layer 50.

The resulting lifter 40 preferably appears as a solid, integral piece of layered metals, or a "layered unitary piece", but, because of the specific layer compositions, is believed to have a response to thermal stresses and repeated impact that is advantageous compared to previous lifter compositions. The lifter 40 tends to be less likely to crack or break, and shows excellent, low rates of wear, resulting in a less frequent need for change-out. Therefore, the invented lifter may reduce the expense in manpower, parts, and downtime that is associated with aircraft and other engine maintenance.

A further object and benefit of many embodiments of the invention is that heat-treating of the lifter to harden the lifter face is not necessary and is not particularly beneficial. The lifter body may be a ferrous material, such as steel, that has been pre-hardened by heat treatment during manufacture (as a conventional step in hardening ferrous alloys such as steels). Said pre-hardening is not utilized in the preferred embodiments of the invention to produce a hard lifter face for contacting a cam surface, but, rather, said pre-hardening may be a step in the manufacture of the original steel or other ferrous alloy. In the preferred embodiments that include a steel lifter body or other lifter body that has been pre-hardened, a face pad is connected to the lifter body and it is that face pad that contacts the cam surface. Thus, there is preferably no heat-treatment or hardening of the invented lifter or lifter body after the preferred invented face pad has been connected to the lifter body, and there is preferably no heat-treatment to harden the contact face of the invented lifters. Also, preferably, the invented face pad connected to the lifter body comprises no heat-treated steel or heat-treated ferrous alloy. Thus, the preferred embodiments of the invention may be differentiated from conventional aircraft lifters, said conventional aircraft lifters being low grade steel that is heat-treated to harden the low grade steel, especially so that the hardened low grade steel face surface may serve as the face that contacts the cam surface. Further, the preferred embodiments are differentiated from conventional aircraft lifters by other ways, including that the contact surface or "contact face " of the preferred embodiments for contacting the cam is not cast iron, steel, stainless steel, or another ferrous alloy or hardened ferrous alloy.

A hard, non-brittle face pad is attached to the lifter body, in a way that helps cushion the lifter from damage, either to the face pad or to the lift body. Thus, these embodiments of the invention tend to prevent the need to harden the surface of the lifter body itself, and, hence, may cut down on the steps and complexity of preparing the lifter body. Thus, various grades of steel may be used for the lifter body, including lower grades.

Alternative embodiments of the invention may include other hard face pads such as other metals, ceramics, and composite materials. Alternative connecting materials may be silver only, silver with only traces of other materials, silver with other central layers besides copper, zinc, and cadmium, or other non-silver welding/brazing materials. The inventor has found that a wafer connector without a copper-based central layer and made only of silver, is not as effective as the silver-copper-silver wafer, but a silver-only connecting material is still within the scope of some embodiments of the invention. The inventor believes that the preferred copper alloy layer, bound to the ferrous alloy body and to the metal carbide face pad by means of the silver welding material layers, forms a type of cushion or buffer between the two very dissimilar materials of the body and the face pad. The copper "cushion" appears to lessen the effects of the shocks from impact on the face pad by the cam and/or the shocks of the temperature changes in the combustion engine environment.

EXAMPLE OF MANUFACTURE

A lifter according to one embodiment of the invention may be made by the following steps:

1) Provide a 1⅕ inch diameter, 2¼ inch long body—a cylinder of iron alloy, cut and milled from a long bar of AMS #4771.
2) Clean body with alcohol, and apply flux to rid of oxygen.
3) Place silver-copper based wafer in between the body and a metal carbide face pad (for example, as described above), and insert as an assembly into induction unit.
4) Heat induction weld unit 1370 degrees F., heating up over about 60 seconds, and then shut off after temperature reached.
5) Let induction unit with welded assembly (lifter) therein cool in ambient conditions.
6) Remove assembly, descale it with sand blasting, and grind (with diamond stones) both the body and the face pad attached to the body, to desired dimensions.
7) Grind a crown onto the face pad using diamond stone, the crown preferably being a slight rounding of the face pad, at approximately a 62 inch radius (preferably 55-70 inch radius).
8) Apply bluing procedure to entire lifter for anti-corrosion, using conventional blueing art, such as: dip lifter into "Safe Scrub" cleaner, rinse, dip lifter into acid solution called "Safe Prep," wash lifter, dip/coat with blackening "Presto-Blackening," wash again, and add rust-preventive oil film over the lifter for storage.
9) Machine internal bore of the lifter (for hydraulic piston, check valve, and spring).
10) Test by ultrasound, to determine the quality of bond of the face pad to the body, via the wafer weld—this testing being effective as sound doesn't pass through the lifter when the bond is poor (discontinuous/weak), but sound does pass through the lifter when the bond is good (continuous/strong).
11) Assembled/packages in a kit with: lifter, piston (with cap, spring, ball and return spring) and plunger.

Preferably, the above steps do not include hardening by heat-treatment of the lifter or its face pad. In some embodiments, the lifter body, such as the body cut in the above method from a cylinder of iron alloy, may have been pre-hardened by heat-treatment during the conventional manufacture of the alloy, prior to being provided to the present inventor, but, as discussed earlier in this Description, said pre-hardening is not done by the present inventor in manufacture of his lifters, and the inventor prefers that no hardening by heat-treatment be done to his finished lifter, to the face pad of his lifter, or to the contact face of the face pad of his lifter. In many embodiments, this is an advantage over conventional low grade steel lifters, the faces of which are heat-treated to harden them in an attempt to make them more durable. The preferred embodiments provide enhanced durability and performance without the heat-treatment steps employed on conventional steel lifters.

Therefore, although this invention has been described above with reference to particular means, materials and embodiments, it is to be understood that the invention is not limited to these disclosed particulars, but extends instead to all equivalents within the scope of the following claims.

I claim:

1. A valve system lifter for use with a cam and a push rod in a combustion engine, the lifter comprising:

a lifter body comprising a first material selected from the group consisting of cast iron, steel, stainless steel, ferrous alloy, non-ferrous material, bronze, and copper-based non-ferrous materials, wherein the lifter body is adapted for connection to a push rod;

a face pad, comprising a second material selected from the group consisting of metal carbide, tungsten carbide, refractory metal carbide, cemented tungsten carbide, tungsten carbide with cobalt binder, cobalt, titanium carbide, niobium carbide, and tantalum carbide;

a connector material connecting said face pad to the lifter body so that the face pad is adapted to contact a cam, said connector material having two layers comprising silver and a layer comprising copper.

2. A valve system lifter as set forth in claim 1, wherein said lifter body is stainless steel.

3. A valve system lifter as set forth in claim 1, wherein said layer comprising copper is located between said two layers comprising silver.

4. A valve system lifter as set forth in claim 3, wherein said layer comprising copper also comprises zinc and cadmium.

5. A valve system lifter as set forth in claim 1, wherein the lifter is not hardened by heat-treatment after the face pad is attached to the lifter body.

6. A valve system lifter as set forth in claim 1, wherein said lifter body is not hardened by heat-treatment after connection of the face pad to the lifter body.

7. A valve system lifter as set forth in claim 1, wherein said face pad has a face for contacting the cam and said face is not hardened by heat-treatment.

8. A valve system lifter as set forth in claim 1, wherein said first material is a ferrous alloy that has been pre-hardened by heat-treatment during manufacture of said first material and prior to having said face pad connected to said lifter body.

9. A valve system lifter as in claim 1, wherein the face pad is a disc 75-150 thousandths of an inches thick, the connector material is 10-20 thousandths of an inch thick.

10. A valve system lifter as in claim 1, wherein each of the layers comprising silver are 2-8 thousandths of an inch thick, and the layer comprising copper is about 10-14 thousandths of an inch thick.

11. A valve system lifter as set forth in claim 1, wherein said connector material includes three layers, which are a central layer of a mixture of said copper, cadmium, zinc and nickel, and two outer layers on opposing sides of the central layer comprising silver.

12. A method of making a combustion engine lifter, the method comprising:

providing a connector wafer comprising two layers including silver and a layer including copper;

providing a lifter body of a first metal selected from the group consisting of cast iron, steel, stainless steel, ferrous alloy, non-ferrous material, bronze, and copper-based non-ferrous materials;

providing a lifter face pad comprising a second metal different from said first metal, said second metal selected from the group consisting of metal carbide, tungsten carbide, refractory metal carbide, cemented tungsten carbide, tungsten carbide with cobalt binder, cobalt, titanium carbide, niobium carbide, and tantalum carbide;

providing said connector wafer between said lifter body and said face pad so that said two layers comprising silver contact said lifter body and said face pad; and induction welding said connector wafer between the lifter body and the lifter face pad, wherein said silver liquefies and bonds to the face pad and to the lifter body.

13. A method as in claim 12, not including hardening by heat-treatment of the face pad.

14. A method as in claim 12, not including hardening by heat-treatment of the lifter body after bonding of the face pad to the lifter body.

15. A method as in claim 12, comprising rounding the face pad to have a radiused outer edge.

16. A method as in claim 12, comprising grinding the face pad to have a radius in the range of 55-70 inches.

17. A valve lifter made according to the method of:

providing a connector wafer comprising two layers including silver and a layer including copper;

providing a lifter body of a first metal selected from the group consisting of cast iron, steel, stainless steel, ferrous alloy, non-ferrous material, bronze, and copper-based non-ferrous materials;

providing a lifter face pad comprising a second metal different from said first metal, said second metal selected from the group consisting of metal carbide, tungsten carbide, refractory metal carbide, cemented tungsten carbide, tungsten carbide with cobalt binder, cobalt, titanium carbide, niobium carbide, and tantalum carbide;

providing said connector wafer between said lifter body and said face pad so that said two layers comprising silver contact said lifter body and said face pad; and induction welding said connector wafer between the lifter body and the lifter face pad, wherein said silver liquefies and bonds to the face pad and to the lifter body.

18. A valve lifter as in claim 17, wherein the face pad is not hardened by heat-treatment.

19. A valve lifter as in claim 17, wherein the lifter body is not hardened by heat-treatment after bonding of the face pad to the lifter body.

20. A valve lifter as in claim 17, wherein the face pad has a radiused outer edge.

* * * * *